US006160870A

United States Patent [19]

Jacobson

[11] Patent Number: 6,160,870

[45] Date of Patent: Dec. 12, 2000

[54] X-RAY MARKERS

[76] Inventor: Donald R Jacobson, 914 Dixie Ct., Waukesha, Wis. 53189

[21] Appl. No.: 09/200,573

[22] Filed: Nov. 27, 1998

[51] Int. Cl.[7] ..... H05G 1/28

[52] U.S. Cl. ..... 378/165; 378/162

[58] Field of Search ..... 378/162–165

[56] References Cited

U.S. PATENT DOCUMENTS

| | | | |
|---|---|---|---|
| 4,035,653 | 7/1977 | Karasko | 250/475 |
| 4,058,733 | 11/1977 | Stembel | 250/476 |
| 4,121,108 | 10/1978 | Manor | 250/476 |
| 4,127,774 | 11/1978 | Gillen | 250/476 |
| 4,194,122 | 3/1980 | Mitchell et al. | 250/476 |
| 4,274,006 | 6/1981 | Caine | 250/476 |
| 4,426,723 | 1/1984 | Rouse | 378/165 |
| 4,429,412 | 1/1984 | Pierce et al. | 378/165 |
| 4,529,635 | 7/1985 | Sheldon | 428/40 |
| 4,698,836 | 10/1987 | Minasian | 378/162 |
| 4,764,948 | 8/1988 | Hurwitz | 378/165 |
| 5,115,461 | 5/1992 | Kranz et al. | 378/165 |
| 5,232,452 | 8/1993 | Russell et al. | 604/180 |
| 5,323,443 | 6/1994 | Lary | 378/165 |
| 5,394,456 | 2/1995 | Livingston | 378/162 |
| 5,592,527 | 1/1997 | Ray | 378/165 |
| 5,640,438 | 6/1997 | Talluto et al. | 378/165 |
| 5,659,592 | 8/1997 | Robertson et al. | 378/165 |
| 5,702,128 | 12/1997 | Maxim et al. | 283/81 |
| 5,732,122 | 3/1998 | Tibbals | 378/162 |

*Primary Examiner*—Craig E. Church
*Attorney, Agent, or Firm*—Quarles & Brady LLP

[57] ABSTRACT

An X-ray marker includes a shaping material formed with a base having a substantially constant thickness and pattern formed in the base having a thickness different than the base. An X-ray attenuator is suspended in the shaping material creating a composite material having a substantially uniform density. The X-ray absorption of the base varies in proportion with the base thickness. Therefore, the different thicknesses of the base forms an image corresponding to the pattern when the marker is disposed over an X-ray sensitive image receptor and exposed to X-rays.

16 Claims, 1 Drawing Sheet

X-RAY MARKERS

BACKGROUND OF THE INVENTION

The field of invention is X-ray markers, more particularly X-ray markers formed from a single composite material.

X-ray markers are used to identify images produced using X-ray imaging. The markers are disposed between an X-ray source and X-ray sensitive image receptor, such as film, and produce identifying indicia on the image receptor by selectively blocking X-rays emitted by the source.

A typical X-ray marker, such as described in U.S. Pat. Nos. 4,035,653 and 4,121,108, is formed by shaping an X-ray absorbing material, such as lead, in the form of a predetermined identifying indicia. The shaped material is then encapsulated in a plastic which does not absorb X-rays to form the marker.

Other methods of forming an X-ray marker such as disclosed in U.S. Pat. No. 4,274,006 includes concentrating a lead powder in grooves formed in a plastic plate. The patterns define the desired indicia. In U.S. Pat. No. 5,394,456, materials having different X-ray attenuating properties is disclosed which are overlapped to form a pattern having a greater X-ray attenuation than the non-overlapped materials.

All of the above disclosed markers require defining identifying indicia by concentrating an X-ray attenuating material in the shape of the desired pattern. The concentrated attenuating material is then encapsulated or otherwise fixed to provide a marker. Concentrating the X-ray attenuating material in a desired pattern complicates the marker fabrication process increasing costs.

Furthermore, X-ray markers must often be used on both a horizontal and a non-horizontal support platform. When a platform is horizontal, the marker can be placed on the platform without it falling off. However, when the platform is angled or vertical, some means is required to hold the marker in place.

Typically, adhesives are used to stick the marker to a surface. After continued use, however, the adhesives becomes fouled and fail to stick. The marker must then be discarded or the adhesive renewed. Other methods, known in the art, include affixing a suction cup or clip to the marker, which further increase the cost of the marker.

BRIEF SUMMARY OF THE INVENTION

The present invention provides a marker suitable for use disposed between an X-ray sensitive image receptor and an X-ray source to provide predetermined identifying indicia on the X-ray sensitive image receptor when the image receptor is exposed to X-rays emitted by the source. The marker includes a shaping material formed with a base having a substantially constant thickness and pattern formed in the base having a thickness different than the base. An X-ray attenuator is suspended in the shaping material creating a composite material having a substantially uniform density. The X-ray absorption of the base varies in proportion with the base thickness. Therefore, the different thicknesses of the base forms an image corresponding to the pattern when the marker is disposed over an X-ray sensitive image receptor and exposed to X-rays.

A general objective of the present invention is to provide an X-ray marker that is easy to manufacture and use. This objective is accomplished by providing a composite material for use as an X-ray marker with a substantially uniform density which attenuates X-rays in a pattern without concentrating X-ray attenuating material.

Another objective of the present invention is to provide an X-ray marker which adheres to a non-horizontal surface without adhesives. This objective is accomplished by providing an X-ray marker formed from a composite material with a smooth surface which adheres to other smooth surfaces.

The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
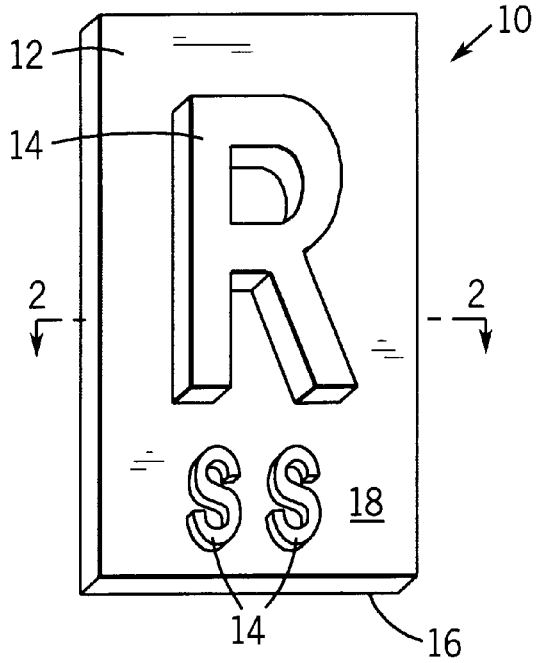
FIG. 1 is a perspective view of an X-ray marker incorporating the present invention.
Figure 2:
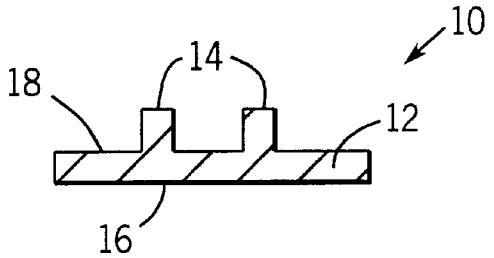
FIG. 2 is a cross section view along line 2—2 of FIG. 1.

Referring to FIGS. 1 and 2, an X-ray marker 10 formed from a composite material has a thin base 12 with raised portions 14. The marker 10 is disposed on a solid flat object (not shown), such as an X-ray support platform interposed between an X-ray source and an X-ray sensitive image receptor. By selectively absorbing X-rays emitted by the source, an image replicating the raised portions of the marker 10 is produced on the image receptor.

The thin base 12 is formed from a composite material and has a substantially smooth bottom surface 16 and a top surface 18. The bottom surface 16 engages the support platform disposed between the X-ray source and X-ray sensitive image receptor. The bottom surface releasably attaches to the platform, such as by applying adhesives or the like to the bottom surface, to allow any orientation of the surface without the marker falling off.

Preferably, the base 12 is formed from a composite material which when formed with the substantially smooth bottom surface 16 adheres to a relatively flat object without the use of adhesives. Advantageously, if the adhering bottom surface 16 becomes soiled, it can be washed off to restore its adhering qualities. By providing a marker 10 having a smooth bottom surface which adheres to other smooth objects, the marker 10 can be used on non-horizontal smooth objects without additional means to maintain the marker 10 in position.

The top surface 18 has raised portions 14 formed as an integral part of the base 12. The raised portions 14 form a pattern which extends from the top surface 18 and define letters or symbols, such as prescribed by the American College of Radiology, for use as identifying the conditions of production of an X-ray image. Such conditions include, but are not limited to laterality, X-ray beam direction, technologist initials and the like.

The composite material absorbs the X-rays emitted by the X-ray source in relation to the composite material thickness. Therefore, the raised portions 14 absorb a greater amount of X-rays than the surrounding base 12. The disparity in X-ray absorption results in an image formed on the X-ray sensitive image receptor which substantially duplicates the pattern of the raised portions 14.

Although a base 12 having raised portions 14 is described herein, the disparity in X-ray absorption can be accomplished by forming indentations or voids defining a pattern in the base. The indentations allow a greater amount of X-rays to pass through the pattern and form an image in the X-ray sensitive image receptor without departing from the scope of the present invention.

The composite material includes a shaping material and an X-ray attenuator. Other materials, such as solvents, binding agents, curing accelerators, or color additives may also be included in the composite material to provide specific desirable properties, such as color, flexibility, short curing time or the like, to the composite material.

The shaping material provides the marker 10 shape and is a flexible plastic or rubber based base material, such as latex, urethane, or epoxy. Preferably, the shaping material has adhering properties, such as urethane which adheres to smooth objects when formed with a smooth surface.

The X-ray attenuator is suspended in the shaping material and absorbs X-rays to form an image on the X-ray sensitive image receptor. Importantly, the X-ray attenuator is dispersed throughout the shaping material providing the composite material with a substantially uniform density to avoid unwanted images forming on the X-ray sensitive image receptor. Advantageously, by forming the marker with a composite material having a substantially uniform density, simple fabrication techniques, such as molding, casting, or the like, may be employed.

X-ray attenuators such as, lead, tantalum, barium, barium sulfate, barium titanate, and compounds thereof may be used. Barium sulfate is preferred because it is inexpensive, readily available, non-toxic, and non-reactive with the preferred shaping material. Preferably, the X-ray attenuator is in the form of a powder which is easily dispersed within with the shaping material.

In a preferred embodiment, the composite material includes approximately 25% to 75% of urethane by weight and 75% to 25% of barium sulfate by weight to provide a marker having a base thickness of approximately 0.04 to 0.06 inches with raised portions extending another 0.09 to 0.11 inches from the base top surface. Most preferably, the composite material includes approximately 50% of urethane by weight and approximately 50% of barium sulfate by weight to provide a marker having a base thickness of approximately 0.05 inches with raised portions extending approximately another 0.1 inches from the base top surface. Of course, other combinations of X-ray attenuator density and raised portion height may be used, such as less barium sulfate in combination with a greater raised portion height, to produce a similar image without departing from the scope of the present invention.

Preferably, the urethane is a castable transparent urethane elastomer such as SkinFlex III provided by BJB Enterprises, Garden Grove, Calif. The SkinFlex III is provided as a three part mixture which are combined in differing quantities to form an elastomer having desired properties. The three part mixture includes Part A (polyurethane resin), Part B (polyurethane curing agent), and Part C (plasticizer-ester). Part A is mixed with Part B at an approximately 1 to 2 ratio (i.e. 1 part of Part A is added to 2 parts of Part B) by weight to form the urethane.

Part C is added to the mixture of Part A and Part B to provide a more flexible article. Preferably, 0% to 50% by weight of Part C is mixed with the Part A/Part B mixture to provide the shaping material for the marker. Most preferably, approximately 10% by weight of Part C is mixed with the Part A/Part B mixture to provide a marker which sufficient flexibility for easy handling and adhesion qualities when provided with a substantially smooth base bottom surface.

The marker 10 is fabricated by mixing the shaping material, X-ray attenuator, and any other desired additives together to uniformly disperse the X-ray attenuator and create the composite material. Appropriate amounts of Part A, Part B, and Part C are combined and mixed for approximately 1 to 2 minutes to form uncured urethane (i.e. in a fluid state). The X-ray attenuator is mixed into the uncured urethane thoroughly dispersing the powder throughout the uncured urethane mixture. Any other additives, such as a color additive, available from M-F Manufacturing in Texas or BJB Enterprises, is also added to the uncured urethane and thoroughly mixed after Parts A, B, C have been combined.

Figure 3:
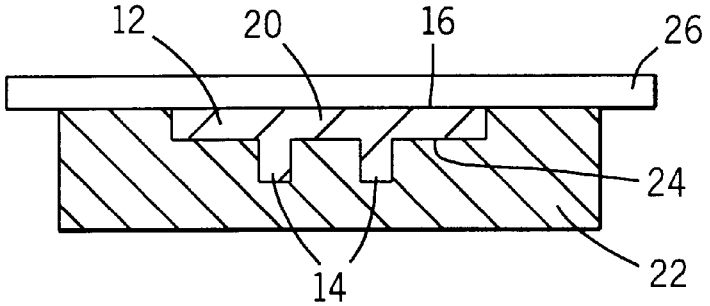
FIG. 3 is a cross section view of a mold forming the embodiment of FIG. 1.

As shown in FIG. 3, the composite mixture 20 is then poured into a mold 22 having a cavity 24 formed therein. The cavity 24 defines the shape of the marker base 12 with raised portions 14. A smooth flat surface 26, such as a glass sheet is placed over the cavity 24 and engages the mixture 20 to form the smooth marker bottom 16. The mixture 20 is then allowed to cure at room temperature. Other composite materials may require different curing procedures known in the art such as by exposing the molding containing the mixture to heat, UV rays or the like. Once cured, the marker 10 is removed from the mold 20 and ready for use.

In another embodiment of the present invention, two composite materials such as described above may be used to form the marker. One composite material having more X-ray attenuator than the other. The composite material having a larger amount of X-ray attenuator is poured into the mold first to fill the raised portions defining the pattern in the marker. Advantageously, this embodiment provides a sharper pattern image on the image receptor, at the expense, however, of increasing manufacturing complexity.

While there has been shown and described what are at present considered the preferred embodiment of the invention, it will be obvious to those skilled in the art that various changes and modifications can be made, therein without departing from the scope of the invention defined by the appended claims.

I claim:

1. A marker suitable for use disposed between an X-ray sensitive image receptor and an X-ray source to provide predetermined identifying indicia on the X-ray sensitive image receptor when exposed to X-rays emitted by the X-ray source, said marker comprising:

a shaping material formed with a base having a substantially constant thickness and pattern formed in said base having a thickness different from said base; and an X-ray attenuator suspended in said shaping material creating a composite material having a substantially uniform density, wherein said composite material attenuates X-rays in relation to said base thickness.

2. The marker as claimed in claim 1, wherein said shaping material is a plastic.

3. The marker as claimed in claim 1, wherein said shaping material is selected from the group consisting of urethane, epoxy, and latex.

4. The marker as claimed in claim 1, wherein said X-ray attenuator is selected from the group consisting of lead, tantalum, barium, barium sulfate, barium titanate, and compounds thereof.

5. The marker as claimed in claim 1, wherein said X-ray attenuator is a powder.

6. The marker as claimed in claim 1, composite materials includes at least one other material.

7. The marker as claimed in claim 6, wherein said other material is selected from the group consisting of a solvent, color additive, binding agent, plasticizer, and curing agent.

8. The marker as claimed in claim 1, wherein said pattern is formed by raised portions extending from said base.

9. The marker as claimed in claim 1, wherein said pattern is formed by voids formed in said base.

10. The marker as claimed in claim 1, wherein said pattern is formed by depressions formed in said base.

11. The marker as claimed in claim 1, wherein said pattern defined identifying indicia.

12. The marker as claimed in claim 1, wherein said base has a substantially smooth bottom.

13. The marker as claimed in claim 8, wherein said raised portions are formed from a second composite material having a density different from said first composite material.

14. The marker as claimed in claim 1, wherein said shaping material is rubber based.

15. A method of forming an X-ray marker suitable for use on non-horizontal surfaces, comprising the steps of:

mixing a curable shaping material in a fluid state;

mixing an X-ray attenuator in said fluid shaping material to provide a composite material having a substantially uniform density;

pouring said composite material into a mold having an open top and a pattern formed therein;

covering said open top and engaging said composite material with a substantially flat surface to form a substantially smooth surface on said composite material; and curing said composite material.

16. The method as claimed in claim 15, further comprising the step of mixing at least one other material with said composite material prior to pouring said composite material into said mold.

* * * * *